US006745530B2

(12) United States Patent
Nesbitt

(10) Patent No.: US 6,745,530 B2
(45) Date of Patent: Jun. 8, 2004

(54) POST CAP

(75) Inventor: Michael John Nesbitt, Kangaroo Point (AU)

(73) Assignee: Grape Essentials PTY Limited (AU)

( * ) Notice: Subject to any disclaimer, the term of this patent is extended or adjusted under 35 U.S.C. 154(b) by 0 days.

(21) Appl. No.: 09/969,689

(22) Filed: Oct. 4, 2001

(65) Prior Publication Data

US 2002/0043036 A1 Apr. 18, 2002

(30) Foreign Application Priority Data

Oct. 12, 2000 (AU) ..... PR0703

(51) Int. Cl.[7] ..... E04H 17/20
(52) U.S. Cl. ..... 52/301; 52/300
(58) Field of Search ..... 52/301, 300; 256/66, 256/65.01, 59, 19; 108/50.02; 312/223.3; D8/386, 349; 215/355, 320; 220/802, 307

(56) References Cited

U.S. PATENT DOCUMENTS

| | | | | | |
|---|---|---|---|---|---|
| 3,233,502 | A | * | 2/1966 | Fernberg | 411/500 |
| 3,349,532 | A | * | 10/1967 | Dudoff | 256/65.02 |
| 4,068,398 | A | * | 1/1978 | Parisi | 40/607 |
| D262,093 | S | | 12/1981 | Bush et al. | |
| 4,823,978 | A | * | 4/1989 | Pufpaff | 220/787 |
| 5,499,737 | A | * | 3/1996 | Kraus | 220/307 |
| 5,695,174 | A | * | 12/1997 | Tsai | 256/19 |
| D416,630 | S | | 11/1999 | Schimmelpfennig et al. | |
| 6,039,307 | A | * | 3/2000 | De Zen | 256/19 |

FOREIGN PATENT DOCUMENTS

| | | |
|---|---|---|
| AU | 80546 | 3/1980 |
| AU | 83837 | 4/1981 |
| AU | 132785 | 2/1998 |
| AU | 134325 | 7/1998 |
| AU | 134326 | 7/1998 |
| AU | 135243 | 10/1998 |
| AU | A-94074/98 | * 2/1999 |
| EP | 0 403 463 | 12/1990 |
| NZ | 197233 | 5/1985 |

* cited by examiner

*Primary Examiner*—Carl D. Friedman
*Assistant Examiner*—Basil Katcheves
(74) *Attorney, Agent, or Firm*—Stites & Harbison PLLC; Marvin Petry

(57) ABSTRACT

A cap (1) is provided for fitting to the end of a hollow post. A number of hollow posts are used in viticulture to support wires on which grape vines are trained to grow. Caps (1) are fitted to the ends of the posts to inhibit snagging of netting which is placed over the posts to attempt to protect a crop of grapes from being eaten by birds. The cap (1) has a generally domed head (3) and a stem (5). The stem (5) has at least one radially outwardly extending abutment (13, 15) which, in use, engages with an inner wall of a hollow post. The abutment (13, 15) provides an interference fit of the stem (5) in the post such that to insert the stem (5) substantially all the way into the post requires force fitting and either deformation or shearing of material from the abutment (13, 15).

24 Claims, 5 Drawing Sheets

POST CAP

FIELD OF THE INVENTION

The present invention relates to a cap for an end of a hollow post.

DESCRIPTION OF PRIOR ART

In viticulture it is common to train vines to grow along wires suspended between posts. In recent times, it has become usual for such posts to be formed of metal. Many such posts are formed by rolling or pressing lengths of metal sheet to form a multi-sided post, the post being hollow in the sense that it surrounds a hollow area. The posts are driven into the ground and wires are threaded through holes or cut-outs in the posts to form a trellis of wires. Vine plants are planted at the base of these wires and, as they grow, are trained to grow along the wires. Sometimes, netting is placed over the mature vines in order to make it harder for birds to eat the grapes. One problem with this technique is that the netting can easily snag on the top of the metal posts when it is being removed, hence damaging the netting. For this reason, post caps have been developed which are fitted to the top of the posts. The netting rests on the post cap, thereby preventing the netting from catching on the post.

The problem with caps currently on the market is that they do not fit tightly enough to the posts to prevent the caps from being pulled off by the nets when the nets are removed. Removal of the nets is done mechanically by a specially designed machine which is driven between two rows of vines to lift the net off the vines to allow the grapes to be harvested. The mechanical nature of the removal makes it difficult for it to be delicate enough to avoid removing the caps. The removal of the caps means that they must be gathered manually, hence increasing the labour component involved in removing the netting. Further, it will be appreciated that caps may be caught up in the netting and require removal and also that caps can be lost or damaged and require replacing.

Further, a number of different post designs are now on the market. Many such posts are formed of sheet metal cut to standard lengths and then rolled or bent to form a post which enclose a hollow such that the transverse cross-section of the post provides rigidity in the post and resists its deformation. Such posts may be open at one side or rolled so that there is only a small gap between the two free edges of the sheet. It is possible that a vine yard would employ a number of different styles of such posts—even for a single row of vines. A disadvantage of current post caps is that they do not fit more than one hollow post.

OBJECTS AND STATEMENT OF THE INVENTION

It is an object of the present invention to overcome one or more of the foregoing problems by providing an alternative post cap.

Accordingly the invention provides a cap for an end of a hollow post, said cap having a generally domed head which, in use, overlies a radially outermost portion of the end of the post, and under said domed head a stem for inserting within the hollow post, said stem having at least one radially outwardly extending abutment means extending along the length of said stem for engaging with an inner wall of the post when said stem is inserted in end of the post, said abutment means serving to provide an interference fit of the stem in the end of said post such that to insert said stem substantially all the way into the end of said post requires force fitting and either deformation or shearing of material from said abutment means.

Preferably, the cap is for an end of a post that has a transverse cross-sectional shape with multiple inner corners and where said abutment means includes at least two single wall flanges extending along the length of the stem, one flange being for engaging with one of said inner corners and the other flange being for engaging with another of said inner corners.

Preferably, said abutment means includes at least four flanges said flanges being arranged in pairs on opposite sides of said stem, the flanges of a pair being spaced apart from each other whereby each pair of flanges may engage a pair of inner corners of said posts.

Preferably, where said post has an opening extending along its length defined by two inturned lips of the posts, the inturned lips abut against one of the pairs of spaced flanges.

Preferably, said inturned lips engage with the sides of said flanges.

Preferably, said stem is hollow.

Preferably, the transverse cross-section of said stem has the shape of a flattened oval, the flattened portions being sides of said stem and the rounded portions being ends.

Preferably, said at least four flanges are located in two pairs on respective sides of said stem.

Preferably, said abutment means includes at least one flange on either end of the stem said flange is extending radially at an angle of approximately 90° to said side flanges.

Preferably, said stem has a slot in each side to enable a wire to pass through said stem.

Preferably, the head is hollow and has radially extending head flanges formed on the undersurface of the dome, said head flanges having a slot therein to receive the thickness of the material of the end of the post when the cap is fitted as far as possible over the end of the post.

Preferably, said head flanges have slots at different radial distances to fit said cap to post having different transverse cross-sectional profiles Preferably, said abutment means is spaced and sized to enable fitting of said cap to posts that have different transverse cross-sectional profiles so one of said caps can be fitted to one or other of the posts depending on which post is chosen.

DETAILED DESCRIPTION OF PREFERRED EMBODIMENT

Figure 1:
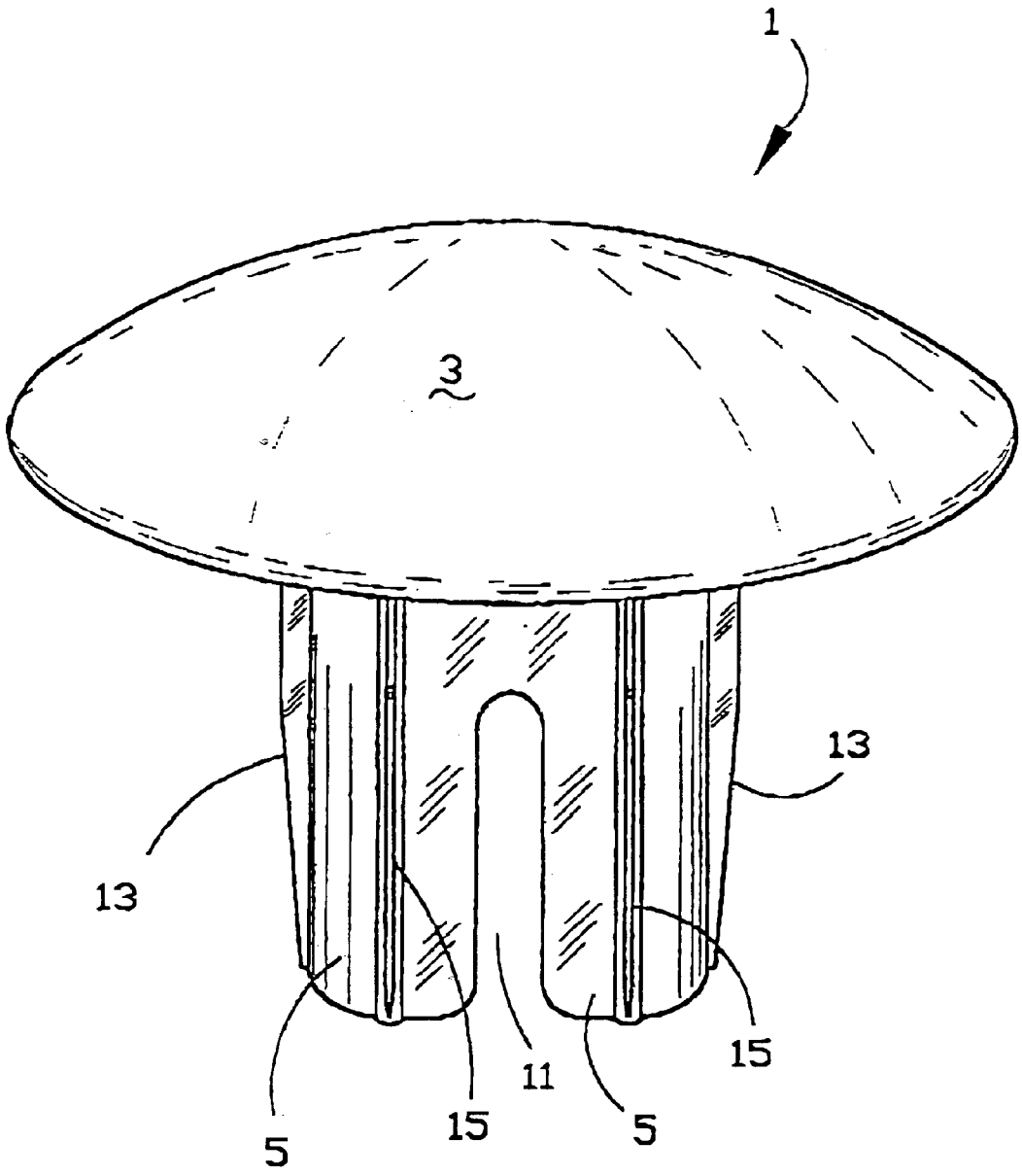
FIG. 1 shows a top perspective view of an example of the post cap of the preferred embodiment.

Referring to FIG. 1, it will be apparent that the cap 1 of the example of the preferred embodiment consists generally of a generally domed head 3 and a stem 5.

Figure 2:
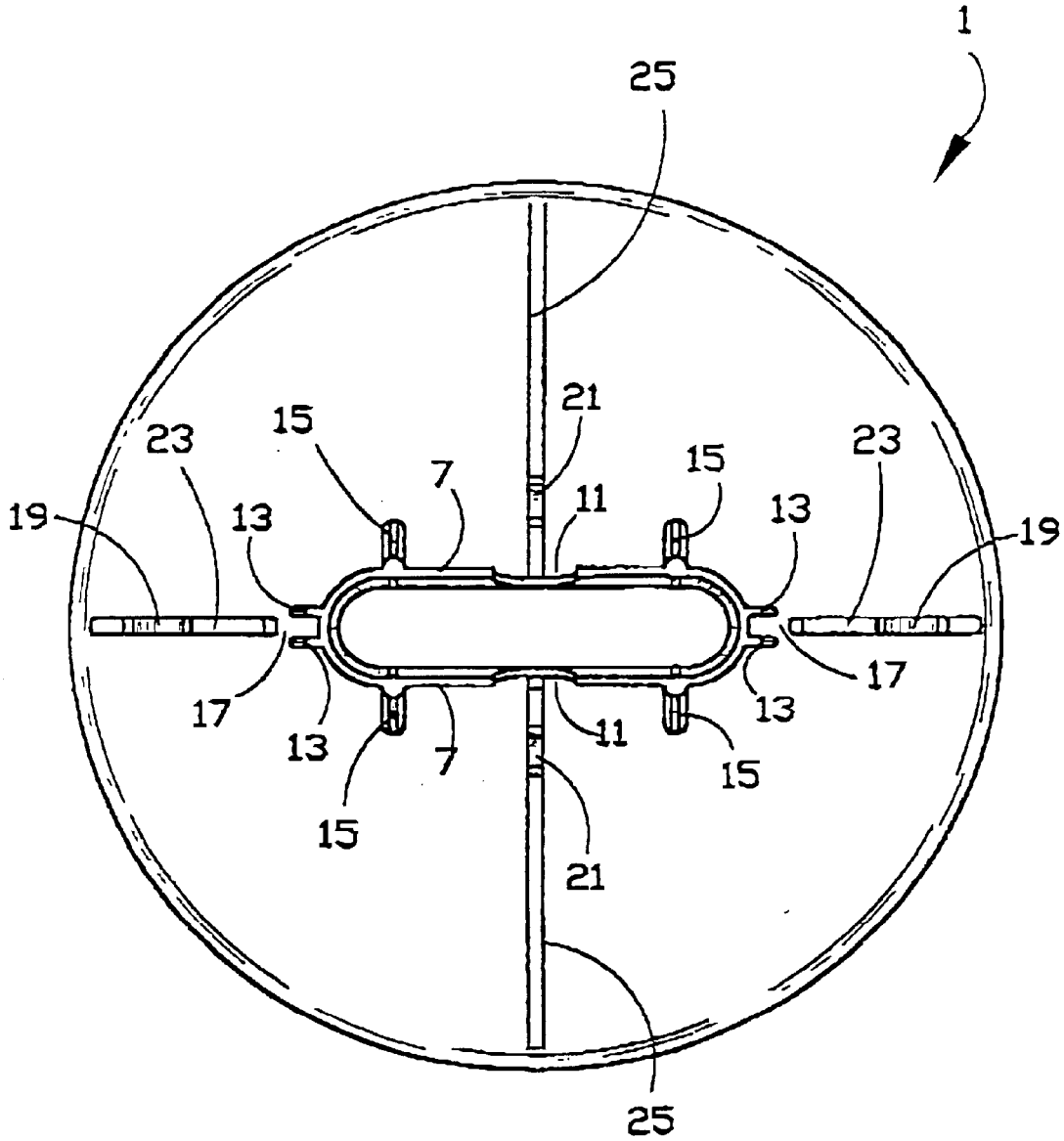
FIG. 2 is an Underneath view of the post cap of the preferred embodiment.
Figure 3:
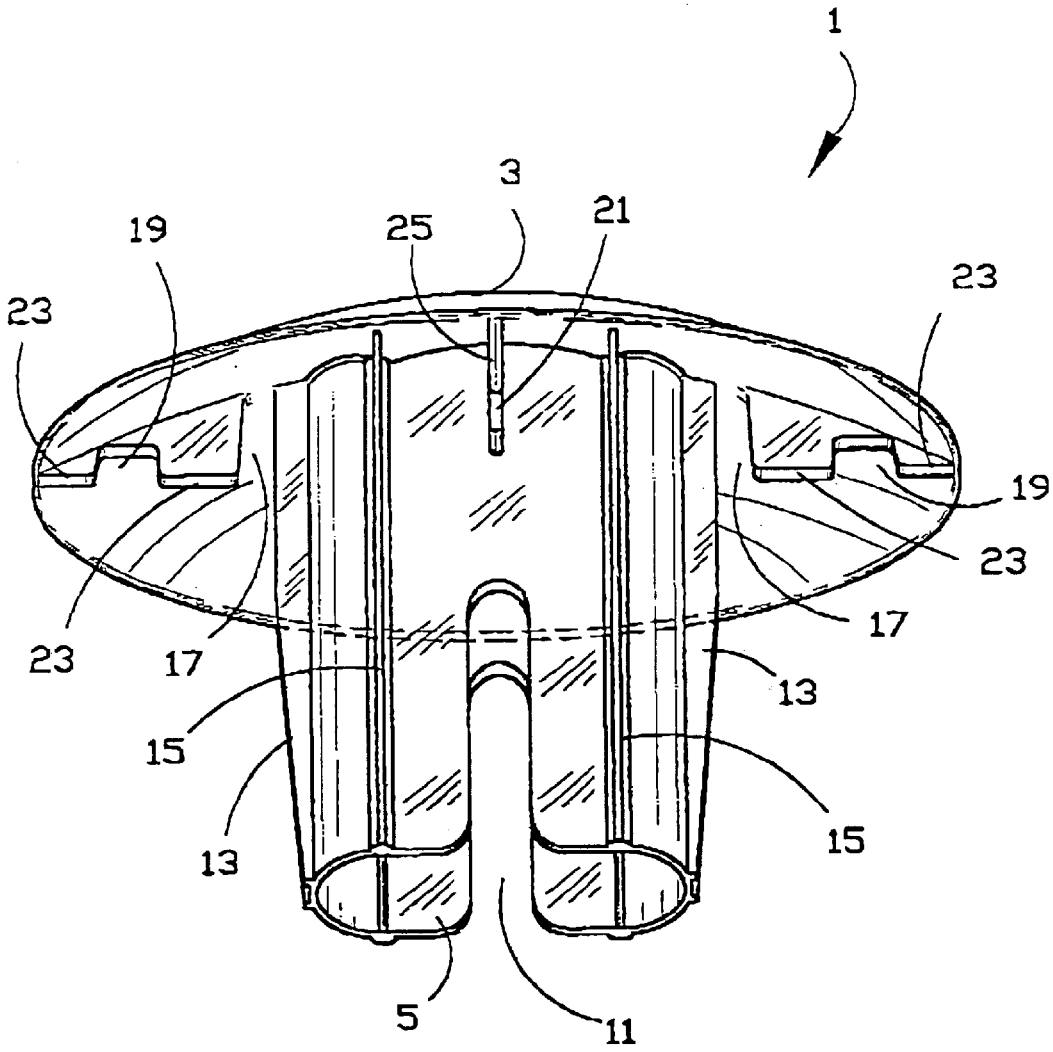
FIG. 3 is a front underneath perspective view of the post cap of the preferred embodiment.

Referring to FIG. 2, it will be apparent that the stem 5 has a flattened oval transverse cross-section, with two straight side portions 7 and two curved portions 9. The sides 7 have cut-out portions 11 which define a slot through which a stabilising wire passing from one stake can pass.

As will be apparent from FIG. 2, the stem has abutment means, preferably in the form of a plurality of single wall flanges 13, 15 which are designed to abut against the interior corners of hollow posts.

Figure 4:
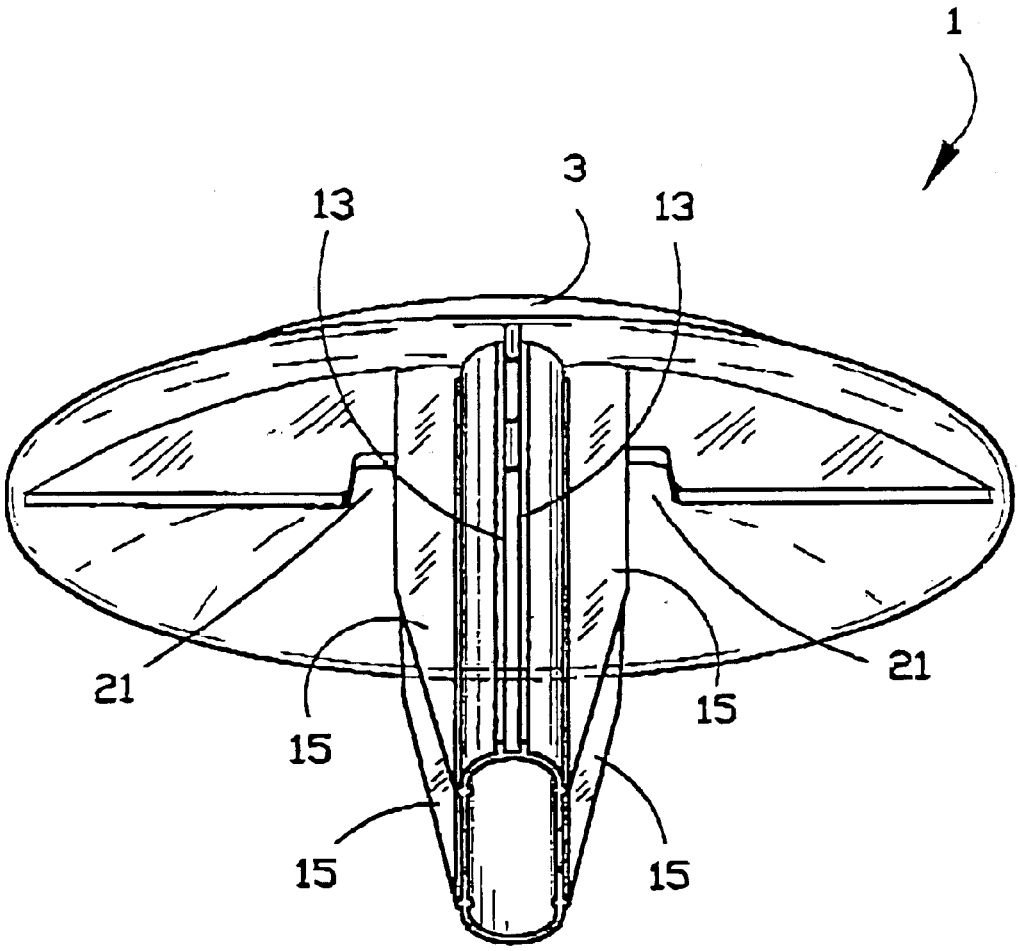
FIG. 4 is a side underneath perspective view of the post cap.

It will be noted that the flanges 13 at the curved ends 9 of the stem 5 taper inwardly towards the free end of the stem. Similarly, as shown in FIG. 4, side flanges 15 also taper inwardly. The tapering of the stem 5 and side flanges 15 permits ready fitting of the cap 1 to a post where the cap is a tight fit as the tapered portions fit readily within the hollow interior of the posts. Further, the ends of the posts are occasionally deformed when they are hammered into the ground, and the tapered flanges and ends of the stem 5 permits the cap to be fitted into such deformed posts more readily.

A further feature of the cap is that the provision of slots 17 and 19 on head flanges 23, 25. The domed head 3 has end flanges 23 and side flanges 25 which have a plurality of slots therein. The inner end slots 17, outer end slots 19, and side slots 21 are designed so as to fit over the edges of the posts and to receive the thickness of the material to thereby hold the cap in place on the post. The location of parts of the ends of the posts within the slots will prevent rotation of the cap and hence, resist removal of the cap 11. The cap 1 is made of a resilient plastic material so that the stem may deform slightly as it is force fitted into the top of a hollow post. The resilience of the cap 1 means that it tends to force itself outwardly against the interior walls of the posts. Where the post is particularly narrow the flanges may shear on insertion into the posts.

The manner in which the cap fits to three different posts will be described with reference to FIGS. 5 to 7. In each of these Figures, the slots which receive various edges of the various posts are shown in order to permit better understanding of the invention.

Figure 5:
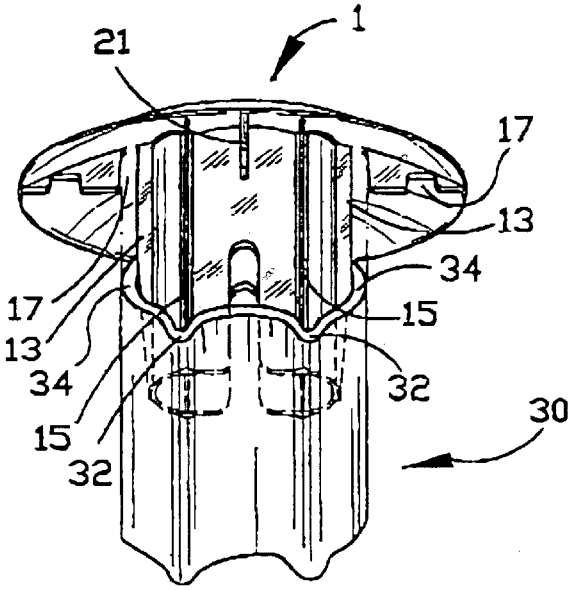
FIG. 5 illustrates how the post cap fits a first type of post.

FIG. 5 shows a post cap 1 as it is being fitted to a post sold under the name "Grip Fast" by BHP Pty Ltd. in Australia. Side flanges 15 abut against inner corners defined by convex portions 32 of the "Grip Fast" post 30. Further, the end portions 34 of the post 30 are received within inner end slots 17. Side slot 21 fits over a concave portion of the "Grip Fast" post 30 which is obscured from view by the post cap 1.

Figure 6:
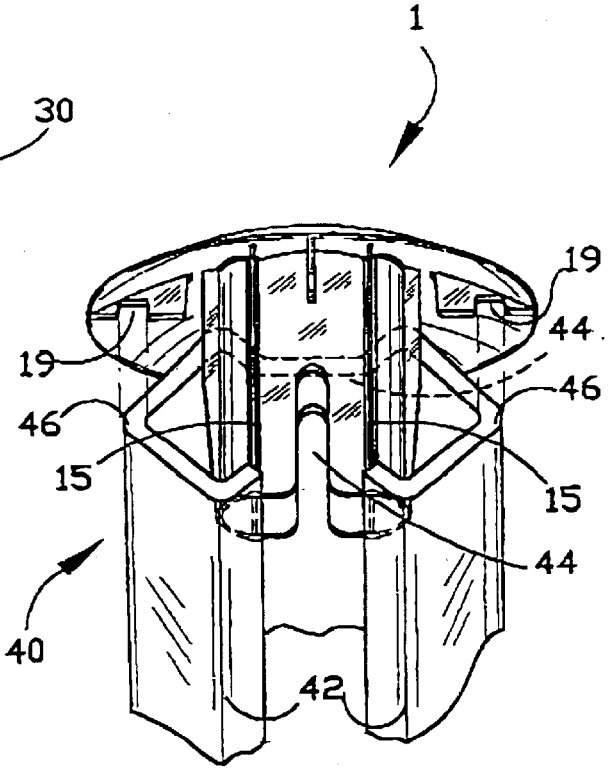
FIG. 6 show the post cap fitted to a second type of post.

FIG. 6 shows a "Smart Post" 40 as manufactured by Vales Statutory Mining Services Pty Ltd of Mossvale NSW, Australia. The "Smart Post" 40 consists of two diamond end portions joined by a convex portion 44 on a rear side and defining a mouth between edges 42. The convex portion 44 and the edges 42 define a plurality of internal corners. The side flanges 15 abut against the edges 42 on the front side and abut against the convex portion 44 on the rear side. The outer end slots 19 fit over the end portions 46 of the post 40.

Figure 7:
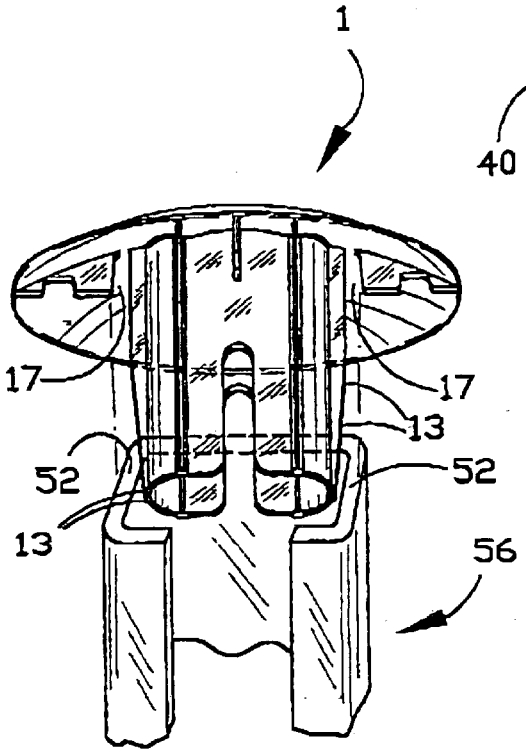
FIG. 7 shows the cap fitted to a third type of post.

Referring to FIG. 7, there is illustrated a "Vinstake" as produced by D M Plastics. Slots 17 and one of side slots 21 fit over the sides 52 of the "Vinstake". It will be apparent that the "Vinstake" has a C-type cross-section. The end flanges 13 of the cap 1 abut against the sides 52 of the "Vinstake" to provide an interference fit.

It will be apparent that various modifications may be made to the post cap of the preferred embodiment without departing from the spirit and scope of the invention. For example, in order to provide the prerequisite interference fit, the flanges 13, 15 need not be continuous along their entire length and could, for example, be crenellated. Further, additional slots could be provided in head flanges 23, 25 in order to accommodate other cross-sections of posts.

These and other modifications will be apparent to persons skilled in the art which will be regarded as falling within the scope of the invention described herein.

The claims defining the invention are as follows:

1. A net support cap for an end of a hollow post, said net support cap comprising:

a generally domed head which, in use, overlies and extends radially outwardly of the end of the post;

a hollow stem under said domed head for inserting within the hollow post, said stem having a substantially smaller cross section profile than a corresponding profile of the hollow post; and at least one outwardly extending single wall flange extending generally perpendicular to said stem and also substantially the length of said stem for engaging with an inner wall of the post when said stem is inserted in end of the post, said single wall flange having a lead-in taper to assist insertion into the hollow post, said single wall flange having a substantial depth in the outward direction serving to provide an interference fit of the stem in the end of said post.

2. The net support cap of claim 1 wherein said cap is adapted for an end of a hollow post that has a transverse cross-sectional profile with multiple inner corners wherein at least two single wall flanges extending longitudinally of said stem, one single wall flange being for engaging with one of said inner corners and the other single wall flange being for engaging with another of said inner corners.

3. The net support cap of claim 1 further comprising at least four single wall flanges, said single wall flanges being arranged in pairs on opposite sides of said stem, said single wall flanges of a pair being spaced apart from each other whereby each pair of single wall flanges may engage a pair of inner corners of the post.

4. The net support cap of claim 2 wherein the post has an opening extending along its length defined by two inturned lips of the post, and wherein, in use, the inturned lips abut against one of the pairs of single wall flanges.

5. The net support cap of claim 4, wherein, in use, the sides of said single wall flanges engage with said inturned lips.

6. The net support cap of claim 3 wherein the post has an opening extending along its length defined by two inturned lips of the posts, and wherein, in use, the inturned lips abut against one of the pairs of single wall flanges.

7. The net support cap as claimed in claim 6 wherein, in use, the sides of said single wall flanges engage with said inturned lips.

8. The net support cap as claimed in claim 1 wherein the transverse cross-section profile of said stem has the shape of a flattened oval, the flattened portions thereof being sides of said stem and the rounded portions thereof being ends, and wherein a wall of a side of said hollow stem can be resiliently deformed inwardly by the lead-in taper of said single wall flange consequent on said stem being force fitted into the hollow post.

9. The net support cap of claim 3 wherein said at least four single wall flanges are located in two pairs on respective sides of said hollow stem.

10. The net support cap of claim 8 wherein, there is a single wall flange on both ends of the hollow stem.

11. The net support cap of claim 1 wherein said stem has a slot to enable a wire to pass through said stem.

12. The net support cap of claim 1 wherein, said domed head is hollow and has head flanges formed on the undersurface of the dome, said head flanges having a slot therein to receive the thickness of the material of the end of the post when the stem is inserted as far as possible into the end of the post.

13. The net support cap of claim 12 wherein said head flanges have multiple slots to fit said cap to a variety of posts having different transverse cross-sectional profiles.

14. The net support cap of claim 1 wherein, said at least one single wall flange is spaced and sized to enable fitting of said cap to a variety of posts that have different transverse cross-sectional profiles.

15. A net support cap for an end of a hollow post, said cap comprising:

a generally domed head which, in use, overlies and extends radially outwardly of the end of the post;

a stem under said domed head for inserting within the hollow post, said stem having at least one outwardly extending abutment means extending along the length of said stem, and being for engaging with an inner wall of the post when said stem is inserted in end of the post;

said abutment means serving to provide an interference fit of the stem in the end of said post such that to insert said stem substantially all the way into the end of said post requires shearing of material from said abutment means; and said head being hollow and having head flanges formed on the undersurface of the dome, said head flanges having a slot therein to receive the thickness of the material of the end of the post when the stem is fitted as far as possible into the end of the post.

16. The net support cap of claim 15 wherein said head flanges have multiple slots to fit said cap to a variety of posts having different transverse cross-sectional profiles.

17. A system comprising:

a hollow post;

a net support cap in the end of the hollow post, said cap having a generally domed head which overlies and extends radially outwardly of the end of the post;

a stem under said head and having a substantially smaller cross section profile than a corresponding profile of the hollow post, said stem having at least one outwardly extending single wall flange which extends outwardly generally perpendicularly to said stem and also substantially the length of the stem; and said single wall flange having a lead-in taper for assisting in the insertion of the stem into the hollow post, said single wall flange having a substantial depth in an outward direction and engaging an inner wall of the post with an interference fit caused by shearing of material from the single wall flange.

18. The system of claim 17, wherein the end post has a transverse cross-sectional profile with multiple inner corners and including at least two single wall flanges extending longitudinally of the stem, one single wall flange engaging one of said inner corners and the other single wall flange engaging another of said inner corners.

19. The system of claim 17, further comprising at least four single wall flanges, said single wall flanges being arranged in pairs on opposite sides of the stem, said single wall flanges of a pair being spaced apart from each other, each pair of single wall flanges engaging a pair of inner corners of the post.

20. The system of claim 17, wherein the transverse cross-section profile of said stem has the shape of a flattened oval, the flattened portions thereof being sides of said stem and the rounded portions thereof being ends, and wherein a wall of said stem is resiliently deformed inwardly by the said single wall flange consequent on said stem having been force fitted into the hollow post.

21. The system of claim 20, further comprising a single wall flange on both ends of the stem.

22. The system of claim 20, wherein said stem has a slot to enable a wire to pass through the stem.

23. The system of claim 17, wherein said head is hollow and has head flanges formed on the undersurface of the dome, said head flanges having a slot which has received therein the thickness of the material of the end of said post.

24. A system comprising:

a hollow post;

a net support cap in the end of the hollow post, said cap having a generally domed head which overlies and extends radially outwardly of the end of the post;

a stem under said head and having a substantially smaller cross section profile than a corresponding profile of the hollow post, said stem having at least one outwardly extending single wall flange which extends outwardly generally perpendicularly to said stem and also substantially the length of the stem; and said single wall flange having a lead-in taper for assisting in the insertion of the stem into the hollow post, said single wall flange having a substantial depth in an outward direction and engaging an inner wall of the post with an interference fit caused by shearing of material from the single wall flange and deformation of said stem.

* * * * *